United States Patent [19]

Inagaki et al.

[11] 4,435,140

[45] Mar. 6, 1984

[54] COMPRESSOR HAVING ROTOR ROTATING WITHOUT CONTRACTING SIDE PLATES

[75] Inventors: Mitsuo Inagaki; Hideaki Sasaya, both of Okazaki, Japan

[73] Assignee: Nippon Soken, Inc., Nishio, Japan

[21] Appl. No.: 330,581

[22] Filed: Dec. 14, 1981

[30] Foreign Application Priority Data

Dec. 16, 1980 [JP] Japan ..... 55-178358

[51] Int. Cl.[3] ..... F01C 1/00; F04C 2/00

[52] U.S. Cl. ..... 418/259

[58] Field of Search ..... 418/150, 259–269

[56] References Cited

U.S. PATENT DOCUMENTS

| | | | |
|---|---|---|---|
| 1,090,021 | 3/1914 | Burton | 418/266 |
| 2,731,920 | 1/1956 | Scognamillo | 418/265 |
| 3,804,562 | 4/1974 | Hansson | 418/259 |

*Primary Examiner*—Leonard E. Smith
*Assistant Examiner*—Jane E. Obee
*Attorney, Agent, or Firm*—Cushman, Darby & Cushman

[57] ABSTRACT

A vane type rotary compressor comprises a cylindrical housing, side plates secured on axial opposite ends of the housing, a rotor rotatably mounted in the housing and a plurality of vanes each slidably received in one of slots formed in the rotor. The housing, side plates, rotor and vanes cooperates with one another to define a working space of a variable volume. The rotor is formed with an increased diameter portion substantially in a central position of the rotor as viewed in an axial direction of the latter. An axial length ($L_4$) of the increased diameter portion, an axial length ($L_3$) of the vanes, an axial length ($L_2$) of the slots, an axial length ($L_1$) of the housing, distance ($L_5$) between a forward end of the slots and a forward end of the increased diameter portion, and distance ($L_6$) between a rear end of the slots and a rear end of the increased diameter portion have the relationships, $L_1>L_3>L_4$, $L_2>L_3$, $L_3>L_4+L_5$, and $L_3>L_4+L_6$, so as to enable the rotor to rotate without contacting the side plates.

1 Claim, 5 Drawing Figures

COMPRESSOR HAVING ROTOR ROTATING WITHOUT CONTRACTING SIDE PLATES

FIELD OF THE INVENTION

This invention relates to rotary compressors, and more particularly it is concerned with a vane type rotary compressor capable of operating at high speed with a high degree of efficiency which is suitable for use in compressing a refrigerant of an air conditioning system equipped in an automotive vehicle.

DESCRIPTION OF THE PRIOR ART

Figure 1:
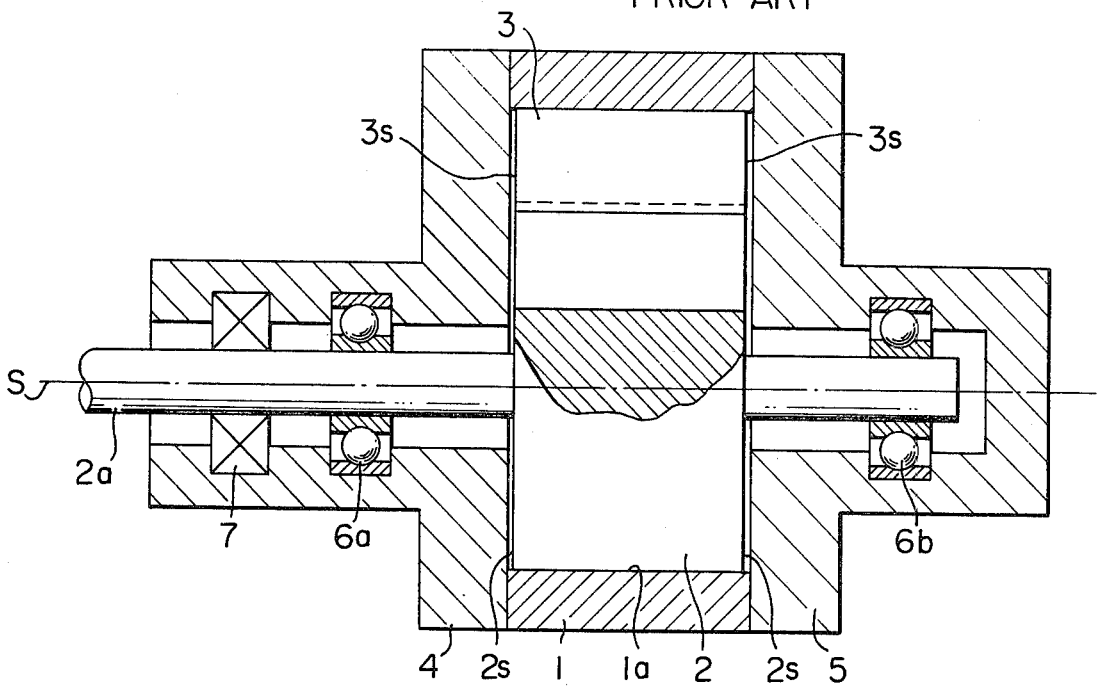
FIG. 1 PRIOR ART
FIG. 1 is a transverse sectional view of a rotary compressor of the prior art.

FIG. 1 shows a rotary compressor of the prior art. The compressor shown in FIG. 1 comprises a housing 1 having a curved inner peripheral surface of the desired shape, a rotor 2 arranged eccentrically in the housing 1, and a plurality of vanes 3 mounted in the rotor 2. The compressor is constituted such that, as the rotor 2 rotates, a space defined by the adjacent vanes 3, the housing 1 in contact with the vanes 3, side plates 4 and 5 located on opposite sides of the rotor 2, and the rotor 2 expands and contracts to perform a pumping operation. In the aforesaid construction of the prior art, no means have ever been provided to effect positioning of the rotor 2 and the vanes 3 in a thrust or axial direction, except that the movements of the rotor 2 and the vanes 3 in the thrust direction are limited by the contact of side surfaces 2*s* of the rotor 2 with the side plates 4 and 5 and the contact of side surfaces 3*s* of the vanes 3 with the side plates 4 and 5.

More specifically, the conventional compressors have been designed without paying special attention to the dimensions of the rotor 2, vanes 3 and the housing 1 in the thrust direction and the dimensional relations of these elements in the thrust direction, except for changes in the dimensions that might be caused by thermal expansion of the materials forming the rotor 2, vanes 3 and housing 1.

Generally, it goes without saying that in this kind of vane type rotary compressor, the dimensional relation between the rotor, the vanes and the housing is the most important factor concerned in the determination of the efficiency with which the rotary compressor operates. In the construction shown in FIG. 1, the rotor 2 is provided with no means for positioning the same in a thrust direction or an axial direction. Thus, when the rotor 2 rotates about its axis S of rotation, the rattling or wabble of the rotor occurs due to a play in the thrust direction of bearings 6*a* and 6*b* journaling the rotor 2 for rotation, or other inevitable cause. Accordingly, when the rotor 2 rotates, particularly at high speed, and especially in the case where the rotor 2 and side plates 4 and 5 are formed of similar materials, the side surfaces 2*s* of the rotor 2 contact the side plates 4 and 5 and the interface may be insufficiently lubricated. This not only increases the drive torque for rotating the rotor 2 but also causes seizure of the rotor and the side plates 4 and 5 to occur.

To avoid the aforesaid increase in the drive torque or seizure, one might think of reducing the dimension of the rotor 2 in the thrust direction to such extent that the rotor 2 is prevented from coming into contact with the side plates 4 and 5. However, the reduction in the dimension of the rotor 2 in the thrust direction cannot be said to be a fundamental solution to the problem because it would increase a leakage area and cause a reduction in efficiency. As another measures for avoiding the increase in the drive torque of the rotor 2 or preventing the seizure of the rotor and the side plates 4 and 5, it has been practiced to apply surface treatment to the side surfaces 2*s* of the rotor 2 and the confronting side plates 4 and 5 so as to improve the slidability therebetween. However, this would not be a perfect solution to the problem since it is troublesome to perform the surface treatment operation and the treated surfaces do not have sufficient endurance.

SUMMARY OF THE INVENTION

It is an object of the present invention to provide a rotary compressor of the type described, which is operable at high speed with a high degree of efficiency by enabling the rotor to rotate without contacting the side plates even if the rotor is rattled or wobbled in a thrust or axial direction.

According to the invention, a rotary compressor comprises a cylindrical housing, side plates secured on axial opposite ends of the housing, a rotor rotatably mounted in the housing and formed with a plurality of slots extending radially of the rotor, and a plurality of vanes each slidably received in one of the slots. The housing, side plates, rotor and vanes cooperate with one another to define a working space of a variable volume. The rotor has an increased diameter portion substantially in a central position of the rotor as viewed in an axial direction of the latter; and the increased diameter portion, the vanes, the slots and the housing have the dimensional relationships expressed by the formulae, $L_1>L_3>L_4$, $L_2>L_3$, $L_3>L_4+L_5$, and $L_3>L_4+L_6$, in which $L_1$, $L_2$, $L_3$, $L_4$, $L_5$ and $L_6$ designate an axial length of the housing, an axial length of the slots, an axial length of the vanes, an axial length of the increased diameter portion, distance between a forward end of the slots and a forward end of the increased diameter portion, and distance between a rear end of the slots and a rear end of the increased diameter portion, respectively.

Additional and other objects, features and advantages of the invention will become more apparent from the description of a preferred embodiment of the invention when considered in conjunction with FIGS. 2–5 of the accompanying drawings.

DETAILED DESCRIPTION OF THE PREFERRED EMBODIMENT

FIGS. 2–5 show a through vane type rotary compressor according to an embodiment of the invention. In FIGS. 2–5, particularly in FIGS. 3–5, the differences in dimensions of the respective elements as measured in a thrust or axial direction are illustrated exaggeratedly with a view to clarifying the essence of the invention.

Figure 2:
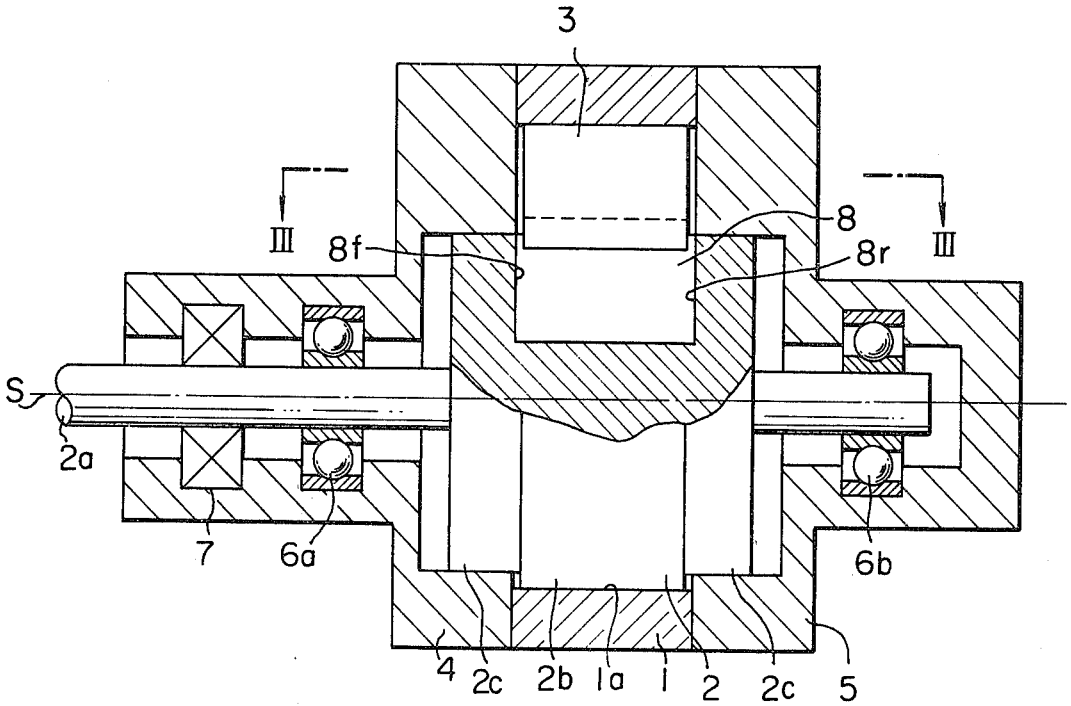
FIG. 2 is a transverse sectional view of a rotary compressor according to an embodiment of the invention.
Figure 3:
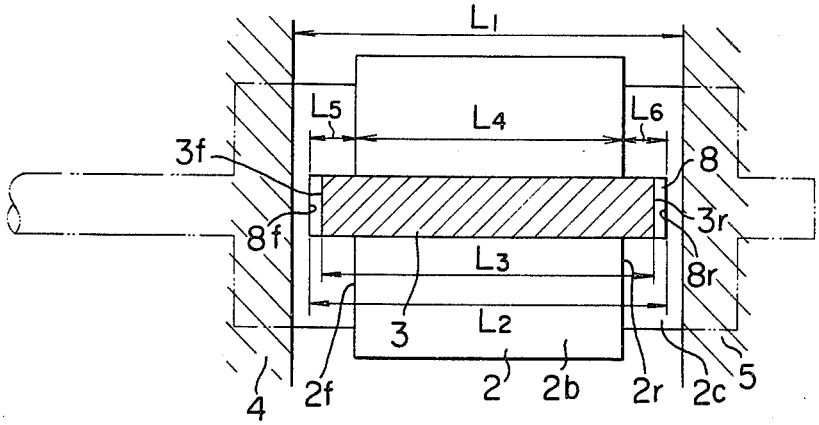
FIG. 3 is a sectional view taken along the line III—III in FIG. 2.

Referring to FIGS. 2 and 3, a front side plate 4, a cylindrical housing 1 and a rear side plate 5 are secured together into a unitary structure by means of bolts, not shown. Between the front side plate 4 and the housing 1 and between the housing 1 and the rear side plate 5 are provided sealing members such as O-rings for sealing the interior of the housing 1, though the sealing member is not illustrated. A radial bearing 6*a* and a shaft sealing member 7 are fitted in the front side plate 4 at their outer peripheral portions, while the inner peripheral portions of the radial bearing 6*a* and the shaft sealing member 7 are fitted on a left portion (FIG. 2) of a rotary shaft 2*a* of the rotor 2. The shaft sealing member 7 performs the function of providing an seal to the interior of the compressor. The rear side plate 5 has a radial bearing 6*b* fitted thereto at its outer peripheral portion, with an inner peripheral portion of the bearing 6*b* being fitted on a right portion (FIG. 2) of the rotary shaft 2*a* of the rotor 2.

The rotor 2 which is unitarily connected to the rotary shaft 2*a* is journaled by the radial bearings 6*a* and 6*b* eccentrically with respect to the housing 1. The rotary shaft 2*a* has an outer end (left end as viewed in FIG. 2) which is subject to motive force from an engine of an automotive vehicle through pulleys or the like, not shown. The rotor 2 is formed with a plurality of radially extending slots 8, and a vane 3 is received in each of the slots radially slidably with respect to the rotor 2. When the rotor 2 is rotated at high speed, the vanes 3 move at high speed while contacting with the two side plates 4 and 5. Consequently, the vanes 3 are formed of the materials which are preferably slidable with respect to the side plates 4 and 5. The movement of the vanes 3 in a thrust or axial direction is regulated or limited by the length of the slots 8 in the thrust direction. The rotor 2 has an increased diameter portion 2*b* in the central portion thereof as viewed axially which is in sliding contact with an axial sealing portion 1*a* of the housing 1. Thus, a working space is defined between the housing 1, front side plate 4, rear side plate 5, increased diameter portion 2*b* of the rotor 2 and adjacent vanes 3. The volume of the working space is increased or reduced as the rotor 2 rotates.

The rotor 2 includes small diameter portions 2*c* on both sides of the increased diameter portion 2*b*. One of the small diameter portions 2*c* faces the inner surface of one side plate 4 while the other small diameter portion 2*c* faces the inner surface of the other side plate 5, and these small diameter portions 2*c* form cylindrical sealing portions.

As shown in FIG. 3, the dimensions of the vanes 3, slots 8, housing 1 and increased diameter portion 2*b* of the rotor 2, as measured in a thrust direction or a direction of an axis S of the rotary shaft 2*a*, are determined to satisfy the formulae, $L_1 > L_3 > L_4$, and $L_2 > L_3$. In these formulae, $L_1$, $L_2$, $L_3$ and $L_4$ denote width or axial length of the housing 1, width or axial length of the slots 8, width or axial length of the vanes 3 and axial length of the increased diameter portion 2*b* of the rotor 2. It is herein to be noted that, as previously described, the differences in dimensions in the thrust direction of the elements are illustrated in FIG. 3 in an exaggerated manner, and that actual gaps defined in a thrust direction between the vanes 3 and the slots 8, between the increased diameter portion 2*b* of the rotor 2 and the side plates 4 and 5, and between the vanes and the side plates are very small (usually, below 0.1 mm).

The dimensions of the abovementioned elements are determined to satisfy also the following formulae; i.e., $L_3 > L_4 + L_5$, and $L_3 > L_4 + L_6$. In these formulae, $L_5$ and $L_6$ denote the length or distance between a forward end 8*f* of each slot 8 and a forward end surface 2*f* of the increased diameter portion 2*b* of the rotor, and the length or distance between a rear end 8*r* of each slot 8 and a rear end surface 2*r* of the increased diameter portion 2*b*, respectively.

The principles of the invention will now be described by referring to FIGS. 3–5. FIG. 3 shows the increased diameter portion 2*b* of the rotor 2 rotating in the central portion of the housing 1 as viewed axially thereof. In this case, there are small gaps defined between the forward end surface 2*f* of the increased diameter portion 2*b* of the rotor 2 and the front side plate 4, and between the rear end surface 2*r* of the increased diameter portion 2*b* of the rotor 2 and the rear side plate 5 respectively, because the width $L_4$ of the increased diameter portion 2*b* of the rotor 2 is smaller than the width $L_1$ of the housing 1.

Figure 4:
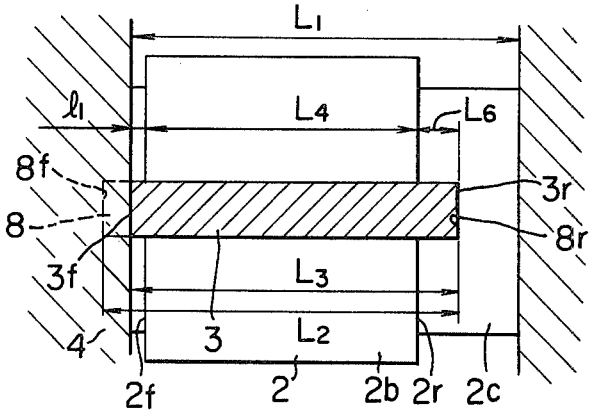
FIG. 4 is a view similar to FIG. 3 but showing the rotor having been moved toward the front.

When the rotor 2 is shifted toward the front as shown in FIG. 4 due to its wobbling or rattling in the thrust direction during rotation, the forward end surface 3*f* of the vane 3 is brought into contact with the front side plate 4 and the rear end surface 3*r* of the vane 3 is brought into contact with the rear end 8*r* of the slot 8. In this condition, a small gap $l_1$ ($l_1 = L_3 - L_4 - L_6$) exists between the forward end surface 2*f* of the increased diameter portion 2*b* of the rotor 2 and the front side plate 4 since the dimentional relationship, $L_3 > L_4 + L_6$, is established as described above. Thus, the front side plate 4 and the forward end surface 2*f* of the increased diameter portion 2*b* of the rotor 2 are not contacted with each other.

Figure 5:
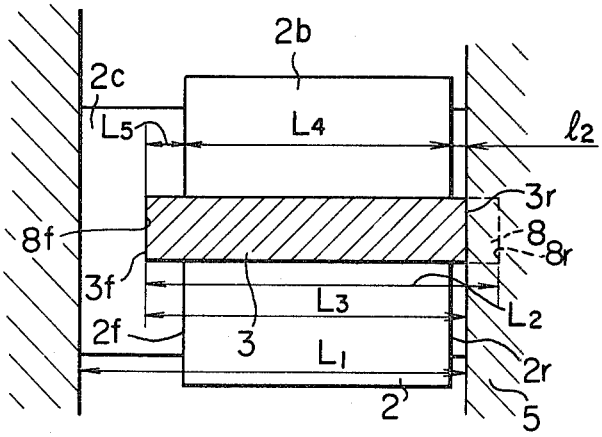
FIG. 5 is a view similar to FIG. 3 but showing the rotor having been moved toward the rear.

Likewise, when the rotor 2 is shifted rearwardly due to wobbling or rattling thereof in the thrust direction during rotation, the rear end 3*r* of the vane 3 is brought into contact with the rear side plate 5, as shown in FIG. 5. In this case, the forward end 3*f* of the vane 3 is brought into contact with the forward end 8*f* of the slot 8. In this condition, a small gap $l_2$ ($l_2 = L_3 - L_4 - L_5$) is defined between the rear end surface 2*r* of the increased diameter portion 2*b* of the rotor 2 and the rear side plate 5 since the dimensional relationship, $L_3 > L_4 + L_5$, is established as described above. Thus the rotor 2 and the rear side plate 5 are not contacted with each other.

From the foregoing description, it will be appreciated that, according to the invention, the rotor is enabled to rotate without contacting the side plates even if large rattling or wobbling of the rotor occurs in the thrust direction during the operation of the rotary type compressor. Consequently, the compressor according to the invention is capable of operating at high speed, with high efficiency and by small drive torque.

What is claimed is:

1. In a rotary compressor comprising:

a cylindrical housing, side plates secured on axial opposite ends of said housing, a rotor rotatably mounted in said housing and formed with a plurality of slots extending radially of said rotor, and a plurality of vanes each slidably received in one of said slots;

said housing, said side plates, said rotor and said vanes cooperating with one another to define a working space of a variable volume;

the improvement wherein:

said rotor has an increased diameter portion substantially in a central position of said rotor as viewed in an axial direction of the latter and diameters smaller than said increased diameter on opposite axial sides thereof;

said slots extend through said increased and smaller diameter portions; and said increased diameter portion, said vanes, said slots, and said housing having the dimensional relationships expressed by the following formulae, $L_1 > L_3 > L_4$, $L_2 > L_3$, $L_3 > L_4 + L_5$, and $L_3 > L_4 + L_6$;

in which $L_1$ = an axial length of said housing, $L_2$ = an axial length of said slots, $L_3$ = an axial length of said vanes, $L_4$ = an axial length of said increased diameter portion, $L_5$ = distance between a forward end of said slots and a forward end of said increased diameter portion, and $L_6$ = distance between a rear end of said slot and a rear end of said increased diameter portion.

* * * * *